US005641061A

United States Patent [19]

de Muylder-Braun

[11] Patent Number: 5,641,061

[45] Date of Patent: Jun. 24, 1997

[54] DISPLAY TRAY

[76] Inventor: Marie-Henriette de Muylder-Braun, Vogelsangstrasse 41, D-75305 Neuenbürg, Germany

[21] Appl. No.: 417,546

[22] Filed: Apr. 6, 1995

[30] Foreign Application Priority Data

Apr. 18, 1994 [DE] Germany ..... 9406432 U

[51] Int. Cl.[6] ..... A47F 3/14; B65D 81/127

[52] U.S. Cl. ..... 206/6.1; 206/564; 206/566; 206/765

[58] Field of Search ..... 206/45.14, 45.19, 206/6.1, 566, 562–564, 765

[56] References Cited

U.S. PATENT DOCUMENTS

| | | | |
|---|---|---|---|
| 3,627,116 | 12/1971 | Cooper | 206/497 |
| 4,153,154 | 5/1979 | Ruscher | 206/566 |
| 4,432,456 | 2/1984 | Ovadia et al. . | |
| 4,917,235 | 4/1990 | Feiler | 206/6.1 |
| 4,993,545 | 2/1991 | Feiler | 206/566 |
| 5,273,153 | 12/1993 | Braun . | |
| 5,273,154 | 12/1993 | Braun | 206/6.1 |

FOREIGN PATENT DOCUMENTS

| | | |
|---|---|---|
| 0032876 | 4/1992 | European Pat. Off. . |
| 8613991.6 | 3/1992 | Germany . |

*Primary Examiner*—Paul T. Sewell
*Assistant Examiner*—Luan K. Bui
*Attorney, Agent, or Firm*—Sprung Horn Kramer & Woods

[57] ABSTRACT

A tray with an interior (2) for displaying objects and with a frame (3) around it. The interior has an upper layer (15) and a lower layer (16) of thin plastic. The objects being displayed rest on the upper surface (18) of the interior. The object of the invention is a tray that is easier to manufacture and use. The upper layer is accordingly manufactured separate from the frame and attached to it later.

12 Claims, 2 Drawing Sheets

DISPLAY TRAY

Figure 1:
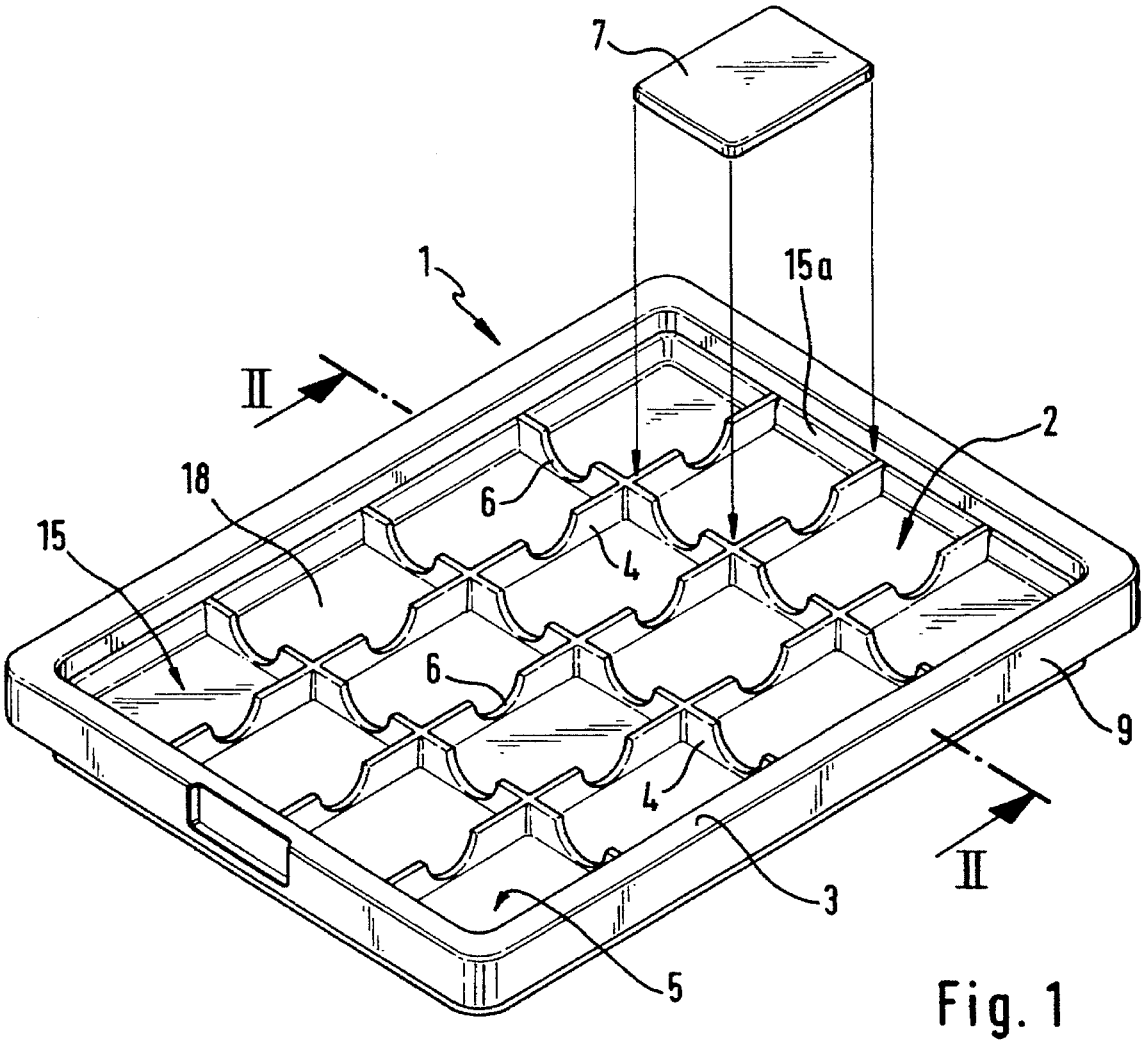

The present invention concerns a tray with an interior for displaying objects and with a frame around the interior.

Display trays are intended to present objects attractively. The present invention is intended in particular for jewelry (including watches) and eyeglasses. Jeweler's shops usually include display cabinets with a number of removable shelves or trays of this type. Display trays are also often intended specifically for use in sales representatives' sample cases. Sample cases can also often accommodate several trays.

The present invention especially concerns display trays for objects that have a low weight as compared to the tray itself.

Display trays in accordance with the present invention are particular appropriate for use in sample cases. The following will refer to jewelry-display trays by way of example but without limiting the scope of the invention to that particular type.

The interior of such a tray can be adapted to a particular purpose. It is often partitioned into several compartments (for bracelets, pendants, necklaces, etc.). Such trays are called compartmented trays. The surfaces of display trays are also often specially contoured for particular purposes. It can for example be contoured to represent the outline of a neck for the purpose of displaying a necklace.

Jewelry-display trays are traditionally extensively produced by hand. The interior can be a layer of wood several millimeters thick with each surface covered with cloth, leather, or plastic and surrounded by a wooden frame.

The traditional manual production of jewelry-display trays is complicated and expensive. The trays are heavy. Heaviness is a particular drawback when they are employed in sample cases. Manual production has, however, usually been considered necessary for reasons of esthetics, which are particularly important in the jewelry trade.

Many attempts have already been devoted to developing an up-to-date jewelry-display tray that would be attractive, light in weight, and easy to manufacture.

An easier-to-manufacture jewelry-display tray is known from German U 8 613 991. The frame comprises four rigid plastic moldings, two of which are extruded lengths of box section. Such trays, however, are heavy and complicated to manufacture.

U.S. Pat. No. 4,432,456 discloses a jewelry-display tray with an interior in the form of a grid of lengths of structural section integrated into a plastic frame. Special plastic structures for supporting the objects being displayed fit snugly into the quadrilateral interstices in the grid. This design is also relatively heavy. Furthermore, the grid is not very pleasing esthetically.

European A 0 032 876 discloses a display tray especially intended for rings. It consists essentially of two sheets of molded plastic with honeycomb-shaped depressions and elevations that fit together. The sheets accordingly constitute an interlocking structure, and the honeycombing and interconnection provide the desired stability.

WIPO 90/15 558 discloses a display tray with a frame comprising a core of rigid expanded plastic with a plastic cover. The cover itself comprises two extended deep-drawn halves. The upper half covers the upper surface of the interior and that of the frame together. The lower half covers the lower surface of the interior and that of the frame together. The supporting structure in the vicinity of the interior in this design is a sheet of cardboard, wood, or plastic accommodated between them. In an alternative version intended for rings, the expanded plastic core of the frame constitutes a support that also extends over the interior and is also accommodated between the two halves.

A display tray with an interior for storing objects for display and with a frame around the interior that is easier to make and use is attained in accordance with the present invention in that the interior has an upper layer of thin plastic with its surface constituting a support for the objects being presented and a lower layer of plastic sheet, whereby the upper layer of the interior is produced separate from the frame and secured to it later. The plastic is a thin sheet or strip of preferably deep-drawn thermoplastic preferably less than 1.5 and especially preferably less than 1 mm thick. The plastic is preferably a relatively rigid plastic.

It is preferable for both the upper layer and the lower layer to be produced separate from the frame and secured to it later. The upper and lower layers are preferably attached, especially cemented together, with no other layer between them.

The characteristics of the present invention result in important advantages in particular for both the manufacturer and the user of the display tray.

First, since the interior and the frame are manufactured separate, the strength, density, rigidity, and thickness of the plastic employed for the interior can be precisely adapted to the particular purpose independent of the specifications for the rest of the tray. The color and texture of the various parts can also be selected to optimize the tray's esthetics.

Second, a single type of frame can be combined with many types of interior. This feature considerably simplifies inventory.

Third, display trays can easily be manufactured to customers' specifications since only a few types of frame (with three different heights for example) can be combined with interiors of many different shapes and materials.

Finally, the tools that manufacture the interior's upper and lower layers (preferably by deep plastic drawing) are simple and accordingly cost-effective.

Surprisingly, jewelry-display trays that are lighter in weight than even the lightest that can be manufactured in accordance with WIPO 90/15 558 can be manufactured with no sacrifice of strength in accordance with the present invention. An only two-layer laminate manufactured from deep-drawn plastic in accordance with the present invention will accordingly prove to be just as rigid as the three-layer laminate described therein with its upper layer of ABS plastic 0.4 mm thick, cardboard core approximately 0.6 mm thick, and lower layer of polystyrene 0.3 mm thick. In the present invention on the other hand a relatively rigid plastic (especially one based on polystyrene) is preferred for both the upper and lower layers, whereby the upper layer is preferably thinner than the lower layer. The upper layer can in particular be approximately 0.2 to 0.7 mm thick and the lower layer approximately 0.3 to 1 mm thick. The two layers together can be not only thinner but also lighter in weight than in known trays. They will, however, be equally stable and, since attractiveness is largely determined by stability, attractive enough to satisfy the esthetic demands on jewelry-display trays.

Figure 3:
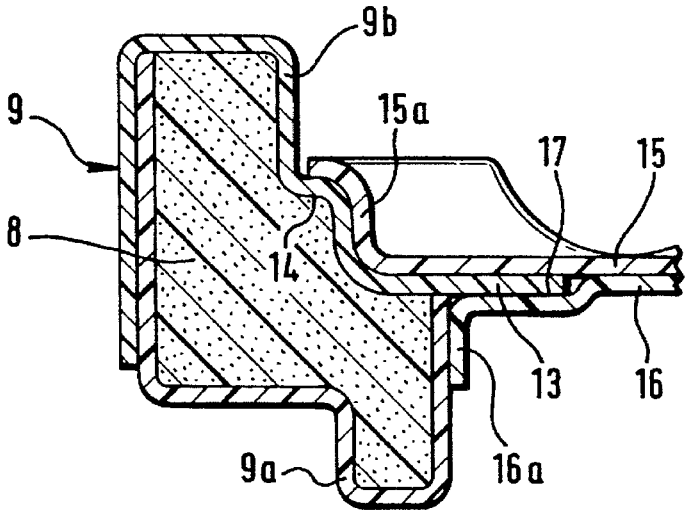
Figure 2:
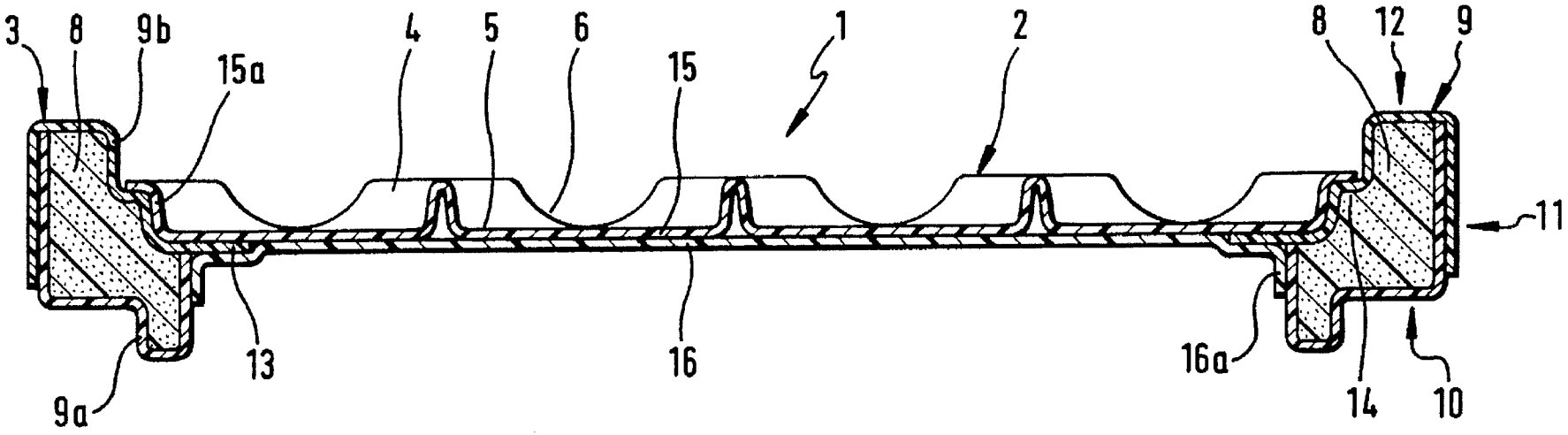

One embodiment of the present invention will now be specified with reference to the accompanying drawing, whereby FIG. 1 is a perspective view of a jewelry-display tray in accordance with the present invention, FIG. 2 a section along the line II—II through the tray illustrated in FIG. 1, and FIG. 3 is a magnified detail from FIG. 2 illustrating the transition between the frame and the interior.

The jewelry-display tray 1 illustrated in the figures comprises an interior 2 and a frame 3. Frame 3 is thicker than interior 2. The upper surface of interior 2 is divided by partitions 4 into several compartments 5 for accommodating pieces of jewelry. The upper edges of partitions 4 are provided with semicircular handling-facilitation cutouts 6. In most cases the jewelry rests on pads 7 that fit into compartments 5.

Details of the design will be particularly evident in FIGS. 2 and 3. Frame 3 comprises a core 8 of rigid expanded plastic with a thin plastic surface 9. Surface 9 is made of two halves **9*a* and 9*b*. Lower half 9*a* extends at least partly (and, in the preferred embodiment, entirely) over the bottom 10 and outside 11 of core 8. The upper half 9*b* of core 8 extends at least partly (and, in the preferred embodiment, entirely) over the top 12 and outside 11 of core 8. Halves 9*a* and 9*b* are attached (and preferably cemented together) to the outside 11 of frame 3**.

Although a frame 3 of the illustrated type is particularly preferred, it is not the only possible type. The edge for example could be wooden or made of injected or extruded plastic section.

Extending out of frame 3 and toward the center of interior 2 is a reinforcing strip 13 with a cross-section in the shape of a bracket. Although the reinforcing strip 13 in the illustrated embodiment is a component of the upper half **9*b* of surface 9, it could just as well be part of lower half 9*a* or be secured to frame 3** in some other way. It ought in any event to consist of thin (usually less than 0.6 mm thick) plastic and be secured to the frame extending toward its center. It is practical for the strip to extend all along the inside of the frame, although it can of course be discontinuous to some extent.

The interior 2 of the illustrated embodiment comprises two layers of thin plastic, specifically an upper layer 15 and a lower layer 16. The layers are manufactured separate from frame 3 and attached to it later. The partitions 4 that demarcate compartments 5 are stamped into upper layer 15. Upper layer 15 is 0.2 to 1.5 mm and preferably 0.3 to 0.7 mm thick and is preferably made of a rigid polyester. Although the lower layer 16 in the illustrated embodiment is essentially flat, it could alternatively be ribbed, corrugated, or otherwise shaped to increase rigidity. It is approximately 0.3 to 1.5 mm and preferably 0.4 to 0.7 thick. Lower layer 16 as well is preferably of a rigid polyester. Both layers together should be no more than 2 mm and preferably no more than 1.2 mm thick.

The bond between interior 2 and frame 3 must be secure and easy to establish while contributing as little as possible to the weight of the overall tray. The illustrated version, with reinforcing strip 13 sandwiched between upper layer 15 and lower layer 16, is the preferred.

The edge **15*a* around the upper layer 15 in the illustrated embodiment is elevated above the upper surface of interior 2. This edge can be produced by deep drawing, along with partitions 4 in the illustrated example. Particularly preferred in this event is an edge as illustrated in FIG. 3 with an ogee cross-section with its outermost section resting on a matching shoulder 14 along the surface of frame 3 facing interior 2. This measure improves the appearance of the tray along with its strength. To further improve strength it is also of advantage for the edge 16*a* around lower layer 16** to be depressed.

Layers 15 and 16 are preferably cemented together over their total contacting surfaces. It is also preferable for upper layer 15 to be cemented to reinforcing strip 13, although it is usually unnecessary to cement lower layer 16 to reinforcing strip 13. Upper layer 15 can also be secured to lower layer 16 by other means strong enough to ensure the permanence of the bond, by hot bonding for example.

It is practical to stamp a shallow groove 17 into the edge of lower layer 16 with its dimensions adapted to those of reinforcing strip 13 to establish a snug fit between reinforcing strip 13 and the gap between upper layer 15 and lower layer 16 at the edge of interior 2 once upper layer 15 has been cemented to lower layer 16.

I claim:

1. A display tray for displaying objects, comprising: a central display section having a predetermined thickness and formed from upper and lower plastic layers; a frame surrounding said display section, wherein said frame has a thickness in cross section greater than the predetermined thickness of the central display section; wherein said frame is manufactured separately from both the upper and lower plastic layers and distinct therefrom and has a reinforcing strip extending towards a central portion of the central display section, wherein the reinforcing strip has an upper surface and a lower surface, wherein an underside of the upper plastic layer contacts the upper surface of the reinforcing strip and an upper side of the lower plastic layer contacts the lower surface of the reinforcing strip continuously around the periphery of the tray thereby sandwiching the reinforcing strip between the upper and lower plastic layers and wherein the reinforcing strip is attached to at least the lower plastic layer.

2. The tray as in claim 1, wherein the upper and lower plastic layers are bonded directly together in the central portion of the central display section.

3. The tray as in claim 1, wherein the upper and lower layers are cemented together.

4. The tray as in claim 1, wherein the upper and lower layers extend essentially over the whole central display section.

5. The tray as in claim 1, wherein the plastic of the upper layer is thinner than the plastic of the lower layer.

6. The tray as in claim 1, wherein at least one of the upper layer and the lower layer is composed of deep-drawn and rigid plastic.

7. The tray as in claim 6, further comprising partitions demarcating compartments stamped into the upper layer.

8. The tray as in claim 1, wherein the upper layer has a surrounding edge strip extending upwardly.

9. The tray as in claim 8, wherein the cross-section of the edge strip is an ogee.

10. The tray as in claim 1, wherein the lower layer has a surrounding edge strip extending downwardly.

11. The tray as in claim 1, wherein the frame has a core of rigid expanded plastic and a surface of thin plastic.

12. The tray as in claim 11, wherein the surface of the frame comprises at least two halves, wherein a lower half extends at least partly over a bottom portion and outside of the core and an upper half extends at least partly over a top portion and outside of the core.

* * * * *